US006969305B2

(12) United States Patent
Kimura et al.

(10) Patent No.: US 6,969,305 B2
(45) Date of Patent: Nov. 29, 2005

(54) POLISHING APPARATUS

(75) Inventors: Norio Kimura, Kanagawa-ken (JP); Tadakazu Sone, Kanagawa-ken (JP); Tomohiko Akatsuka, Tokyo (JP); Tatsuya Sasaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 22 days.

(21) Appl. No.: 10/357,473

(22) Filed: Feb. 4, 2003

(65) Prior Publication Data

US 2003/0166383 A1 Sep. 4, 2003

Related U.S. Application Data

(63) Continuation-in-part of application No. 09/777,707, filed on Feb. 7, 2001, now Pat. No. 6,824,454.

(30) Foreign Application Priority Data

Feb. 7, 2000 (JP) ..... 2000-029008
Feb. 4, 2002 (JP) ..... 2002-027411

(51) Int. Cl.[7] ..... B24B 1/00
(52) U.S. Cl. ..... 451/41; 451/56; 451/285; 451/286; 451/287; 451/288; 451/443; 451/444
(58) Field of Search ..... 451/41, 56, 285, 451/286, 287, 288, 443, 444

(56) References Cited

U.S. PATENT DOCUMENTS 5,857,898 A 1/1999 Hiyama et al.
5,885,137 A * 3/1999 Ploessl ..... 451/56
6,033,290 A 3/2000 Gurusamy et al.
6,123,607 A * 9/2000 Ravkin et al. ..... 451/56
6,306,008 B1 10/2001 Moore
6,514,126 B1 2/2003 Vanell
6,531,399 B2 * 3/2003 Kojima et al. ..... 451/41
6,572,446 B1 * 6/2003 Osterheld et al. ..... 451/24
6,607,426 B2 * 8/2003 Suzuki ..... 451/56

FOREIGN PATENT DOCUMENTS

EP 0816017 1/1998
JP 2001-246550 9/2001

* cited by examiner

*Primary Examiner*—Joseph J. Hail, III
*Assistant Examiner*—Shantese McDonald
(74) *Attorney, Agent, or Firm*—Wenderoth, Lind & Ponack, L.L.P.

(57) ABSTRACT

A polishing apparatus for polishing a substrate comprises a turntable having a polishing surface, a substrate holder for holding a substrate and bringing the substrate into contact under pressure with the polishing surface, a dresser including a dresser tool adapted to be brought into contact under a pressure with the polishing surface to dress or condition the polishing surface and a pressure device connected to the dresser for moving the dresser between a raised position where the dresser is spaced away from the polishing surface and a dressing position where the dresser rests on the polishing surface such that the dresser tool is in contact with the polishing surface under a pressure exerted by the weight of the dresser itself, the dresser comprising a follow-up mechanism allowing each one of dressing element to move up and down relative to a flange portion so as to follow a contour of the polishing surface of the turntable.

12 Claims, 14 Drawing Sheets

POLISHING APPARATUS

This is a continuation-in-part application of U.S. patent application Ser. No. 09/777,707 filed on Feb. 7, 2001.

BACKGROUND OF THE INVENTION

The present invention relates to a polishing apparatus for polishing a substrate, such as a semiconductor wafer. Specifically, the present invention relates to a polishing apparatus including a novel dresser device. The dresser device is used for regeneration (dressing or conditioning) of a polishing surface of a polishing pad or a polishing plate comprising abrasive particles.

The present invention also relates to a polishing apparatus for polishing a workpiece to be polished and in more specific, to a polishing apparatus for polishing a workpiece to be polished, such as a semiconductor wafer and so on, having a thin film deposited on a surface thereof so as to have a flat and mirror finished surface.

A conventional polishing apparatus of the above-mentioned type is shown in FIG. 1. In FIG. 1, the polishing apparatus comprises a turntable (polishing table) 1 having a polishing pad 2 covering an upper surface thereof and a substrate holder 3 for holding a substrate (not shown) to be polished, such as a semiconductor wafer. A substrate is held on a lower side of the substrate holder 3 and is pressed against a polishing surface of the polishing pad 2 on the turntable 1. While pressing the substrate against the polishing surface, an abrasive liquid is supplied onto the polishing surface, and relative movement between the polishing pad 2 and the substrate is conducted by rotating the turntable 1 in a direction indicated by an arrow A and rotating the substrate holder 3 in a direction indicated by an arrow B. Thus, the substrate is polished to a flat and mirror-finished surface. It should be noted that a polishing plate comprising abrasive particles may be used, instead of the polishing pad 2.

In this apparatus, the polishing surface of the polishing pad 2 becomes clogged after polishing of a plurality of substrates, to thereby lower an efficiency of polishing. Therefore, when a predetermined number of substrates have been polished or the efficiency of polishing has been lowered due to clogging, the polishing surface is scraped for dressing, by means of a dresser 4.

The dresser 4 comprises a dresser tool 5 and a dresser shaft 6 for supporting the dresser tool 5. The dresser shaft 6 is adapted to be rotated by means of a rotary mechanism (not shown) in a direction indicated by an arrow C. The dresser tool 5 is adapted to be pressed against the polishing pad 2 by means of an air cylinder 7 and the dresser shaft 6. An annular projection 5*a* is formed on a lower surface of the dresser tool 5. The annular projection 5*a* is formed from a member (such as a diamond pellet) containing diamond particles or a hard material such as a ceramic material. A relative movement between the dresser tool 5 and the polishing pad 2 is conducted by rotating the dresser shaft 6 and the turntable 1, to thereby scrape the polishing surface of the polishing pad 2 for dressing.

For effecting dressing of the polishing surface of the polishing pad 2, air is supplied through the controller 8 to the air cylinder 7, so as to press the dresser tool 5 against the polishing pad 2 under a predetermined pressure. Therefore, the minimum pressure applied to the polishing pad 2 (the pressure when no air is supplied through the controller 8 to the air cylinder 7) is equal to the total of the weight of the dresser tool 5 and the weight of the dresser shaft 6.

During dressing, as shown in FIG. 2, the rate (mm/hr) of scraping of the polishing pad 2 is proportional to the pressure applied to the polishing pad 2. Generally, the total of the weight of the dresser tool 5 and the weight of the dresser shaft 6 is about 10 kg, so that it is impossible to reduce the pressure applied to the polishing pad to less than 100 N (Newton). Therefore, the polishing pad 2 is scraped at a high rate, leading to a rapid wear of the polishing pad 2.

In recent years, as an integration level of semiconductor device progresses, a wiring pattern of circuit has become more micro-fabricated and thereby a space between wirings is getting much narrowed. Especially, in a photo lithography with a line width equal to or less than 0.5 $\mu$m, a shallow focal depth thereof requires a high level of flatness in a surface of the semiconductor wafer on which a stepper forms an image. One of known means available for flattening the surface of such semiconductor wafer is a polishing apparatus that can provide the chemical and mechanical polishing (CMP).

This type of polishing apparatus typically comprises, as shown in FIG. 19, a polishing table 302 with a polishing surface formed by a polishing cloth (a polishing pad) affixed thereon and a top ring 304 for retaining a substrate W such as a semiconductor wafer or the like, which has been prepared as a workpiece to be polished, such that a surface of the substrate W to be polished may face to the polishing table 302. To perform a polishing operation of the semiconductor wafer W by using such a polishing apparatus, the semiconductor wafer W may be pressed against the polishing cloth 300 of the polishing table 302 under a predetermined pressure applied by the top ring 304 while driving the polishing table 302 and the top ring 304 to rotate about their own axes respectively and supplying an abrasive liquid from an abrasive liquid supply nozzle 306 arranged above the polishing table 302.

As for an abrasive liquid supplied from the abrasive liquid supply nozzle 306, for example, a suspension containing abrasive grains composed of fine particles of silica or the likes suspended in an alkaline solution may be used, so that the chemical and mechanical polishing achieved by a combined effect of the chemical polishing action by the alkali with the mechanical polishing action by the abrasive grains may be provided to polish the semiconductor wafer W to have a flat and mirror finished surface. Recently, instead of the polishing cloth, such a bonded abrasive may be used that is composed of the abrasive grains like cerium dioxide (CeO2) or the likes which have been bonded by using a binder.

When such a polishing apparatus is used to carry out the polishing process continuously for a certain time period, the polishing ability of the polishing surface of the polishing cloth 300 may be deteriorated, and so a dresser 308 having a dressing element 310 disposed on an under surface thereof is provided in order to recover this polishing ability, which applies a dressing treatment to the polishing cloth 300 during such an occasion as changing semiconductor wafers W to be polished. In this dressing process, the dressing elements 310 of the dresser 308 are pressed against the polishing cloth 300 of the polishing table 302 while driving them to rotate about their own axes respectively, so that the abrasive liquid and the ground-off chips adherent to the polishing surface may be removed and at the same time, the polishing surface can be flattened and dressed to regenerate the polishing surface. This dressing is also referred to as conditioning.

When the bonded abrasive is used as the polishing surface for example, because the bonded abrasive is not so flexible as the polishing cloth, the surface of the bonded abrasive would not be easily deformed so as to follow a change in the contour of the contact surface of the dressing element 310 of the dresser 308. Consequently, the dressing element 310 cannot come into full-face-contact with the polishing surface of the bonded abrasive but only a part of the dressing element 310 can come into contact therewith. Especially, in case where the bottom surface of the dressing element 310 has a larger area, a contact area of the dressing element 310 with the polishing surface may be significantly small. In such a case, a uniform dressing would not be applied to the polishing surface, which could inversely affect and give some damages to a uniformity of the semiconductor wafer W across a surface thereof and a stability in polishing operation.

Further, in such a case, a larger load tends to be applied locally to a specific region on the polishing surface of the polishing cloth 300 or the bonded abrasive where the dressing element 310 is in contact therewith, which could cause a large-sized defect on the polishing surface and also shorten the lifetime of the dressing element 310. The physical phenomenon pointed above may occur in dependence on a degree of flatness of the dressing element 310 as well as a precision in assembling and installation of the dressing element 310, and it may be remarkably emphasized especially in case of a smaller load applied to the dresser 308.

SUMMARY OF THE INVENTION

In view of the above, the present invention has been made. It is an object of the present invention to provide a polishing apparatus for polishing a substrate comprising a turntable having a polishing surface, a substrate holder for holding a substrate and bringing the substrate into contact under a pressure with the polishing surface to polish the substrate, a dresser including a dresser tool adapted to be brought into contact under pressure with the polishing surface to dress or condition the polishing surface and a pressure device connected to the dresser tool for moving the dresser between a raised position where the dresser is spaced away from the polishing surface and a dressing position where the dresser rests on the polishing surface such that the dresser tool is in contact with the polishing surface under a pressure exerted by the weight of the dresser itself. The pressure device includes a member for applying an upward force to the dresser to decrease the pressure and a downward force to the dresser to increase the pressure.

By this arrangement, the pressure between the dresser tool and the polishing surface of the turntable can be adjusted to a level less than that generated by the weight of the dresser itself. Therefore, dressing of the polishing surface can be conducted while suppressing a rapid wear of the polishing surface.

The dresser may comprise a dresser shaft connected to the dresser tool and extending upward vertically from the dresser tool and the pressure device may comprise a cylinder equipped with a piston to which the dresser shaft is connected. A kinetic frictional resistance against movement of the piston in the cylinder is preferably 0.5 kg or less. First and second pressure supply devices may be fluidly connected to the cylinder so that the first pressure supply device supplies a pressurized fluid to the cylinder to apply an upward force to the piston and the second pressure supply device supplies a pressurized fluid to the cylinder to apply a downward force to the piston.

By preliminarily supplying a pressurized fluid to the above-mentioned cylinder so as to counter the weight of the dresser, the pressure between the dresser tool and the polishing surface of the turntable can be easily minimized to a level less than the weight of the dresser and adjusted to an arbitrary value exceeding that level (for example, a value in a range of 10 N to 300 N).

In accordance with another aspect of the present invention, there is provided a polishing apparatus comprising a turntable having a polishing surface, a substrate holder for holding a substrate and bringing the substrate into contact under pressure with the polishing surface, a dresser tool adapted to be brought into contact under pressure with the polishing surface to dress or condition the polishing surface, and a dresser tool holding device for holding the dresser tool and moving the dresser tool between a raised position where the dresser tool is spaced away from the polishing surface and a dressing position where the dresser tool rests on the polishing surface with a pressure being exerted by the dresser tool on the polishing surface by the weight of the dresser tool itself.

By this arrangement, there is no possibility that a pressure exceeding the weight of the dresser tool will be applied to the polishing surface. Therefore, dressing of the polishing surface can be conducted while suppressing a rapid wear of the polishing pad or plate. The dresser tool holding device may support the dresser tool in such a manner that the dresser tool is substantially freely movable in a vertical direction relative to the dresser tool holding device.

The dresser tool holding device may comprise an air cylinder equipped with a piston connected to the dresser tool to move the dresser tool between the raised position and the dressing position, and there may be provided a shaft extending vertically and having a lower end connected to the dresser tool and an upper end connected to the piston. The dresser tool may be freely movable in a vertical direction relative to the lower end of the shaft. The shaft may be provided at its lower end with a flange extending radially outwardly from the lower end and having vertical through holes formed therein and the dresser tool may be provides with a plurality of vertical connecting pins extending through the through holes of the flange. Each of the connecting pins may be provided with a head adapted to be engaged with an upper surface of the flange when the dresser tool is positioned at the raised position. There may be provided an automatic aligning roller bearing connected between the flange and the dresser tool so that the dresser tool can tilt in compliance with undulations on the polishing surface.

The foregoing and other objects, features and advantages of the present invention will be apparent from the following detailed description and appended claims taken in connection with the accompanying drawings.

The present invention has also been made in the light of the problems associated with the prior art described above, and an object thereof is to provide a polishing apparatus which can dress a polishing surface uniformly and thereby improve the uniformity across a surface of a workpiece to be polished, as observed after its having been polished.

In order to solve the problems associated with the prior art described above, according to a first aspect of the present invention, there is provided a polishing apparatus comprising a polishing table having a polishing surface and a dresser for dressing said polishing surface of the polishing table, in which a workpiece to be polished is pressed against said polishing surface of the polishing table so as to be polished thereby, said apparatus characterized in that said dresser comprises a flange portion capable of moving up and down relative to said polishing surface of the polishing table, a plurality of dressing elements for dressing said polishing surface of the polishing table, and a retainer mechanism for operatively retaining said dressing elements so as to move said dressing elements up and down relative to said flange portion.

With an apparatus having an above configuration, a plurality of dressing elements, each having a smaller bottom surface area, may be individually moved up and down relative to the flange portion so as to positively increase a total contact area of the dressing elements with the polishing surface, so that a uniform dressing of the polishing surface can be provided. Said polishing surface may be made up of a bonded abrasive or a polishing cloth, and in particular, the present invention is suitable for a rigid (exhibiting smaller elastic deformation) polishing tool.

According to an embodiment of the present invention, said dresser further comprises a function allowing each one of said dressing elements to move up and down relative to said flange portion so as to follow the contour of said polishing surface of the polishing table.

With an apparatus having an above configuration, each one of the dressing elements may be independently pressed against the polishing surface so as for the respective dressing elements can individually follow the contour of the polishing surface of the polishing table, so that more uniformly controlled dressing of the polishing surface can be provided. In addition, since the pressing force to be applied to each one of the dressing elements can be adjusted independently, therefore an adequately controlled dressing can be achieved for the polishing surface, thereby improving the uniformity across the surface of the workpiece to be polished, as observed after the polishing process. This may consequently lead to an improvement of yield.

In this case, the above-described function may be made up of such a mechanism that moves said dressing element up and down by using a weight having a predetermined weight or by supplying a fluid pressure.

In an alternative embodiment of the present invention, said plurality of dressing elements comprises different kinds of dressing elements. In this case, preferably said follow-up mechanism should allow the same kind of dressing elements among said different kinds of dressing elements to move up and down together, separately from the other kinds thereof.

With an apparatus having an above configuration, different kinds of dressing elements can be separately used corresponding to different applications, so that the polishing surface can be dressed more adequately. Accordingly, this may help reduce the occurrence of defect and improve the throughput.

According to a second embodiment of the present invention, there is provided a polishing apparatus comprising a polishing table having a polishing surface and a dresser for dressing said polishing surface of the polishing table, in which a workpiece to be polished is pressed against said polishing surface of the polishing table so as to be polished thereby, said apparatus characterized in that said dresser comprises a flange portion capable of moving up and down relative to said polishing surface of the polishing table, a dressing element for dressing said polishing surface of the polishing table, a retainer mechanism for operatively retaining said dressing element so as to move said dressing element up and down relative to said flange portion, and a mechanical vertical motion control mechanism for controlling a position of said flange portion in up and down direction. With the aid of such a mechanical control mechanism, the position of the flange portion can be controlled in the up and down directions even with a rather simplified configuration of the apparatus.

DETAILED DESCRIPTION OF THE INVENTION

Figure 1:
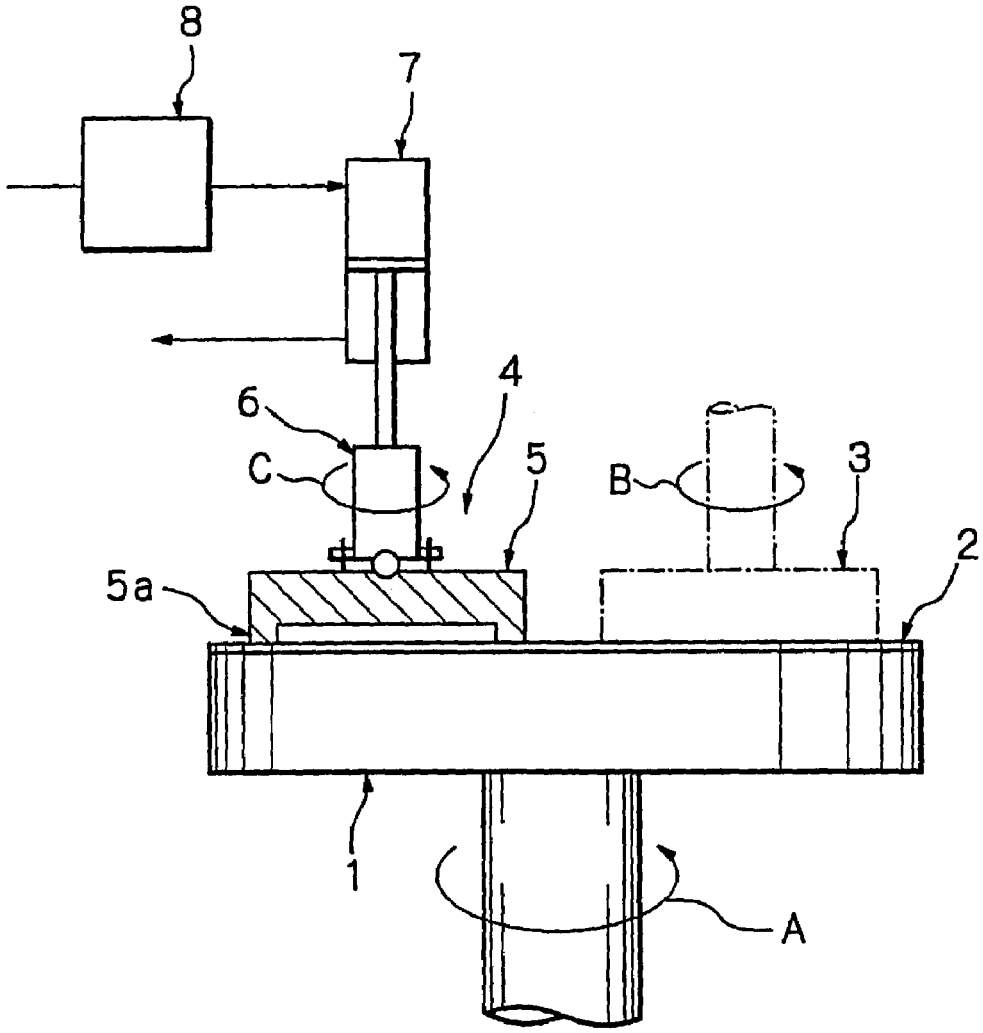
Fig. 1 (PRIOR ART)
FIG. 1 shows an example of a general arrangement of a conventional polishing apparatus.
Figure 2:
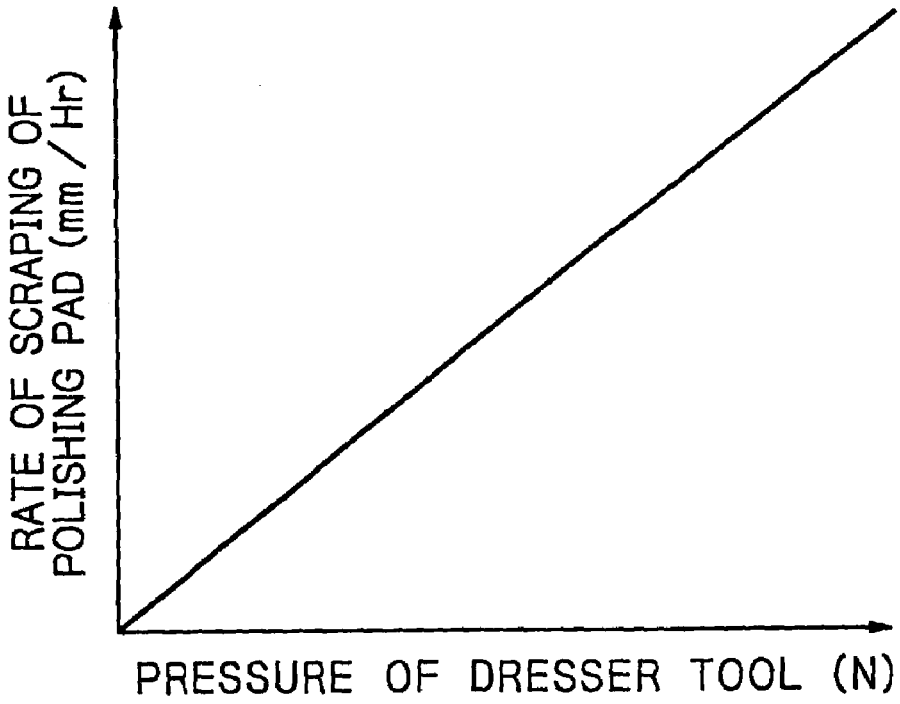
Fig. 2 (PRIOR ART)
FIG. 2 is a graph showing a relationship between the pressure of a dresser tool and the rate of scraping of a polishing pad.
Figure 3:
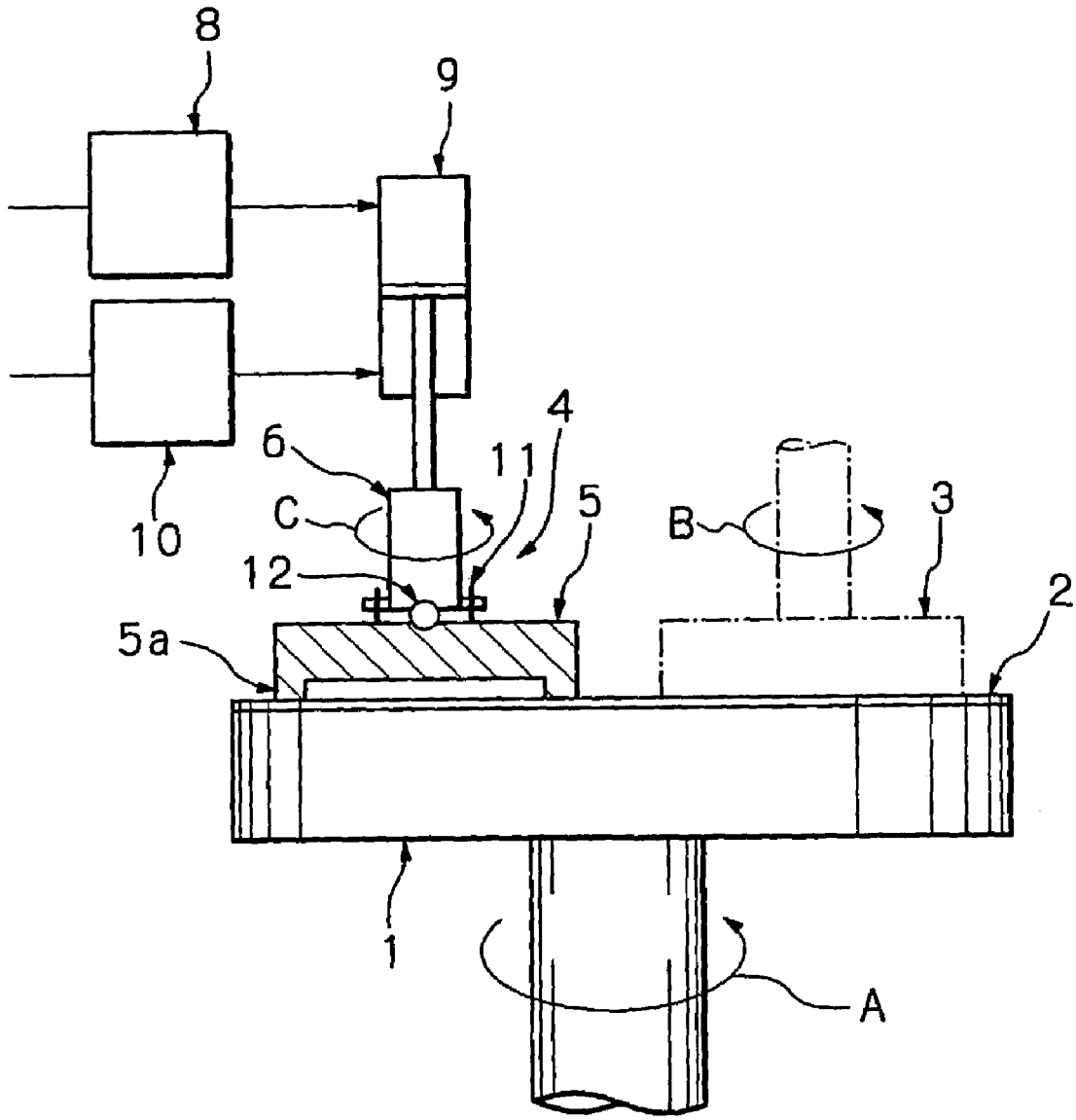
FIG. 3 is a view showing an example of a general arrangement of a polishing apparatus in accordance with an embodiment of the present invention.
Figure 4:
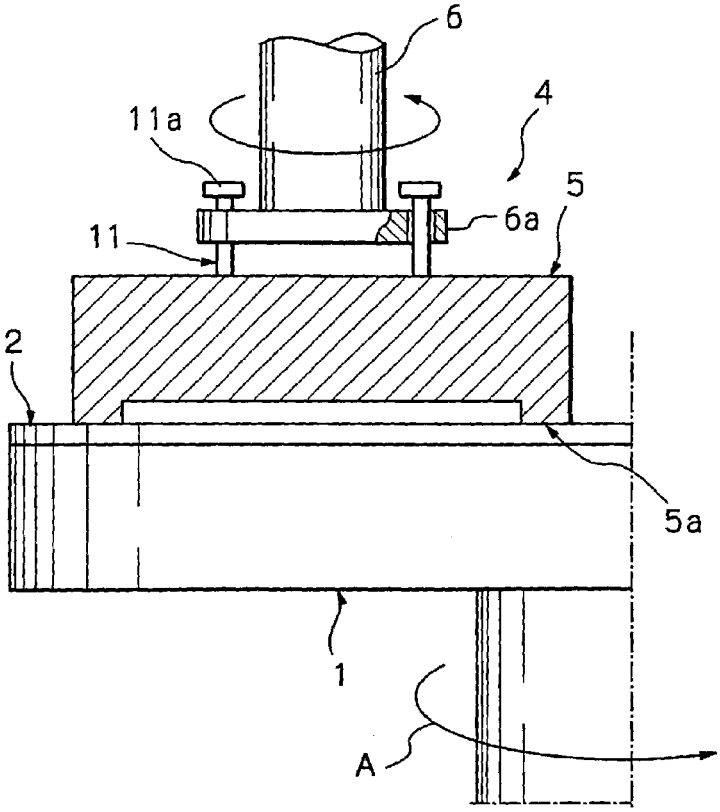
FIG. 4 is a sectional view showing a dresser of a polishing apparatus in accordance with another embodiment of the present invention.
Figure 5:
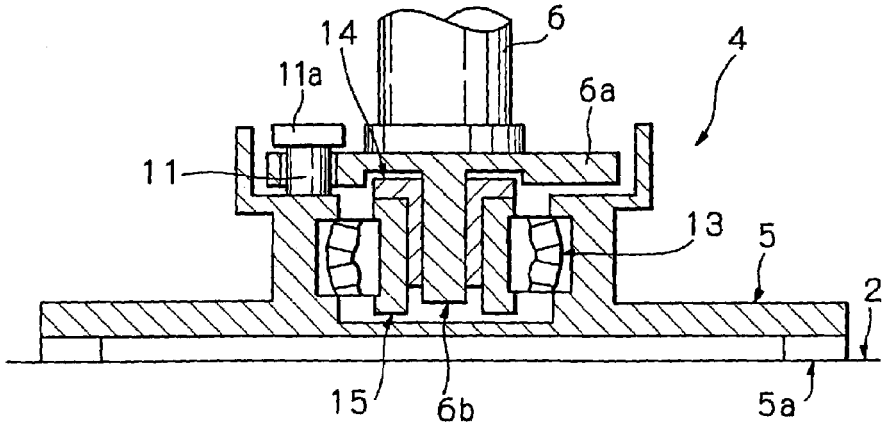
FIG. 5 is a sectional view showing a dresser of a polishing apparatus in accordance with a further embodiment of the present invention.

Hereinbelow, description is made with regard to embodiments of the present invention, with reference to FIGS. 3 to 5. In FIGS. 3 through 5, the same portions as those in FIG. 1 or the portions corresponding to those in FIG. 1 are designated by the same reference numerals as used in FIG. 1. FIG. 3 is a view showing an example of a general arrangement of a polishing apparatus of the present invention. The polishing apparatus includes a turntable 1 with a polishing pad 2 provided on the upper side of the turntable 1, a substrate holder or wafer carrier 3, a dresser 4 and an air cylinder 9 for urging the dresser 4 against the polishing pad 2.

The air cylinder 9 is a low-friction type and the kinetic frictional resistance generated when a piston in the air cylinder 9 is moved is about 0.44 kg or less. Air is supplied through the controller 8 to the air cylinder 9 in a direction for moving the dresser 4 in a downward direction (a direction for pressing the polishing pad 2) and is supplied through a regulator 10 to the air cylinder 9 in a direction for moving the dresser 4 in an upward direction (a direction for countering the weight of the dresser).

In this polishing apparatus, the weight of the dresser tool 5 and the weight of the dresser shaft 6 are set in the regulator 10 and air is preliminary supplied through the regulator 10 to the air cylinder 9 in an amount sufficient for countering the weight of the dresser 4. Therefore, when no air is supplied through the controller 8 to the air cylinder 9, the pressure applied to the polishing pad 2 is zero. Consequently, by adjusting the amount of air supplied through the controller 8 to the air cylinder 9, the pressure applied to the polishing pad 2 can be adjusted to an arbitrary value between zero and a value larger than zero. That is, the pressure of the dresser tool 5 applied to the polishing surface of the polishing pad 2 can be minimized to a level less than the weight of the dresser tool 5 and can be adjusted to an arbitrary value exceeding that level.

As is described above, by supplying air through the regulator 10 to the air cylinder 9 in a direction opposite to the direction of air supplied through the controller 8, the weight of the dresser 4 is countered. In this case, however, the air cylinder 7 of a conventional type shown in FIG. 1 has a problem such that when the pressure applied to the polishing pad 2 is set to be low by the controller 8, it is difficult for an actual pressure applied to the polishing pad 2 to be precisely controlled due to a frictional resistance (slide resistance) of the air cylinder. This problem can be avoided by using the air cylinder 9 of a low-friction type having a frictional resistance of about 0.44 kg or less. By this arrangement, the minimum pressure applied to the polishing pad 2 can be set to a level as low as, for example, 10 N (Newton).

In FIG. 3, reference numeral 11 denotes a torque transmitting pin for transmitting a torque of the dresser shaft 6 to the dresser tool 5. Reference numeral 12 denotes a ball bearing for supporting the dresser tool 5 relative to the dresser shaft 6 in a manner enabling the dresser tool 5 to be inclined relative to the dresser shaft 6.

FIG. 4 shows a polishing apparatus in accordance with another embodiment of the present invention.

In this embodiment, a dresser tool 5 is connected to a dresser shaft 6 by torque transmission pins 11 in such a manner that the dresser tool 5 is movable relative to the dresser shaft 6 in a vertical direction, while the dresser tool 5 is rotated together with the dresser shaft 6. As shown, each torque transmission pin 11 extends through a vertical through hole formed in a flange 6*a* fixedly connected to the lower end of the dresser shaft 6 with a clearance being provided between the outer surface of the pin 11 and the inner surface of the vertical through hole of the flange 6*a*. The torque transmission pin 11 is provided at its upper end with a large diameter head 11*a*. When the dresser shaft 6 is located at an elevated position, a lower surface of the pin head 11*a* is engaged with an upper surface of the flange 6*a* of the dresser shaft 6, whereby the dresser tool 5 is supported by the dresser shaft 6 in a suspended fashion.

To effect dressing, the dresser 4 is moved to a dressing position above the polishing surface of the polishing pad 2. When the dresser shaft 6 is lowered at this position, a lower surface of the dresser tool 5 is brought into contact with the polishing surface of the polishing pad 2. Then, the dresser shaft 6 is further lowered (in a range such that there is no contact between a lower surface of the flange 6*a* and an upper surface of the dresser tool 5), to thereby enable the dresser tool 5 to rest under its own weight on the polishing surface.

As mentioned above, during dressing, the dresser tool 5 is disconnected from the dresser shaft 6 in a vertical direction and rests on the polishing surface of the polishing pad 2 under its own weight. Consequently, the dresser tool 5 is pressed against the polishing pad 2 under a low pressure equal to its own weight, whereby rapid wear of the polishing pad during dressing can be avoided.

FIG. 5 shows a dresser 4 of a polishing apparatus in accordance with a third embodiment of the present invention. In this dresser 4, the dresser tool 5 is supported relative to a bearing support member 15 through an automatic aligning roller bearing 13, in a manner enabling the dresser tool 5 to be inclined relative to the bearing support member 15. The bearing support member 15 is provided with a slide member 14 which enables the support member 14 to vertically move along a guide pin 6*b*, which extends downwards from a flange 6*a* formed integrally with a lower end of a dresser shaft 6. When the dresser shaft 6 is located at an elevated position, the lower surface of the head 11*a* of the torque transmission pin 11 is engaged with the upper surface of the flange 6*a* of the dresser shaft 6 so that the dresser tool 5 is suspended from the dresser shaft 6. This is the same as in the case of the dresser 4 in FIG. 4.

Even when the polishing surface of the polishing pad 2 is inclined, the automatic aligning roller bearing 13 enables the dresser tool 5 to follow the inclined polishing surface and dressing is conducted under a pressure equal to the weight of the dresser tool 5. Therefore, a rapid wear of the polishing during dressing can be avoided.

In the above-mentioned embodiments, a polishing apparatus in which a polishing pad is provided on a turntable is taken as an example. However, this does not limit the present invention. A polishing apparatus in which a polishing plate comprising abrasive particles (an abrasive plate) is provided on the turntable may be used.

Preferred embodiments of a polishing apparatus according to the present invention will now be described with reference to the attached drawings. It is to be noted that in FIG. 6 through FIG. 18, those similar or corresponding elements are designated by similar reference numerals and any duplicated explanations should be omitted.

Figure 6:
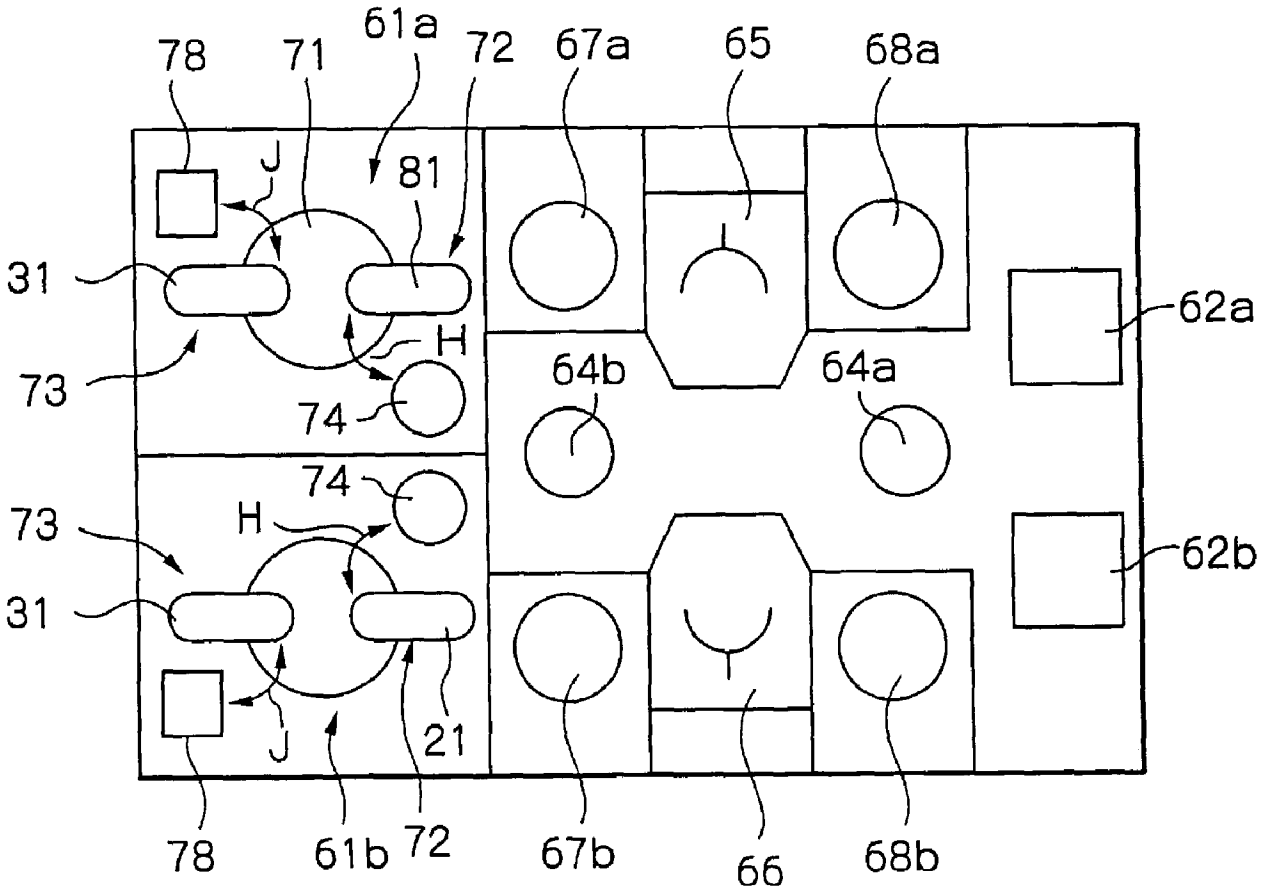
FIG. 6 is a schematic plan view showing a polishing apparatus according to a third embodiment of the present invention.

FIG. 6 is a plan view schematically showing a third embodiment of a polishing apparatus according to the present invention. As shown in FIG. 6, the polishing apparatus comprises a pair of polishing sections 61*a*, 61*b* disposed oppositely in a left side and a right side in one end region of a space on a floor having a rectangle geometry as a whole, and a pair of load and unload units disposed in the other end region thereof, on which cassettes 62*a*, 62*b* for accommodating a semiconductor wafer therein are mounted respectively. Two conveying robots 64*a*, 64*b* for carrying and transferring the semiconductor wafer are disposed on a line connecting the polishing sections 61*a*, 61*b* with the load and unload units 62*a*, 62*b*, thus making up a conveying line. In each opposite side with respect to this conveying line, there are one turnover device 65 or 66 and two cleaning equipment 67*a* and 68*a*, or 67*b* and 68*b* with the turn-over device 65 or 66 interposed therebetween, respectively.

Those two polishing sections 61*a*, 61*b* comprise respective equipment having basically the same specification and located symmetrically with respect to the conveying line, and each unit of equipment comprises a polishing table 71 having a polishing surface formed on an upper surface thereof, a top ring unit 72 for retaining a semiconductor wafer prepared as a workpiece to be polished by a vacuum suction and for pressing said semiconductor wafer against the polishing surface on the polishing table 71 so as to polish the same, and a dressing unit 73 for dressing the polishing surface on the polishing table 71. In addition, each of the polishing sections 61*a*, 61*b* is provided in the conveying line side thereof with a pusher 74 for transferring and receiving the semiconductor wafer to and from the top ring unit 72.

Each of the conveying robots 64*a*, 64*b* has a joint arm capable of bending freely within a horizontal plane and uses two gripping sections, one upper section and one lower section, independently as a dry finger and a wet finger, respectively. In this embodiment, two robots have been employed, wherein a first robot 64*a* is basically in charge of a region defined between the cassettes 62*a*, 62*b* and the turn-over devices 65, 66 while a second robot 64*b* is in charge of a region defined between the polishing sections 61*a*, 61*b* and the turn-over devices 65, 66.

The turn-over device 65, 66 turns the semiconductor wafer surface upside down and are located in a position reachable by the hand of the conveying robot 64*a*, 64*b*, respectively. In this embodiment, two turn-over devices 65 and 66 are employed, which are separately used, one for handling dry substrates, the other for handling wet substrates.

Each of the cleaning equipment 67*a*, 67*b*, 68*a*, and 68*b* may have any arbitrary form, and in one example, the cleaning equipment 67*a*, 67*b* disposed in the polishing section 61*a*, 61*b* side may be embodied in such a form in which both of the front and the backside surfaces of the semiconductor wafer are wiped by using rollers with sponge, and the cleaning equipment 68*a*, 68*b* disposed in the cassette 62*a*, 62*b* side may be embodied in such a form in which the semiconductor wafer is gripped at an edge portion thereof and rotated within a horizontal plane while supplying a cleaning liquid thereto. The latter cleaning equipment may also have a function as a dryer for drying the semiconductor wafer by spin-drying. In the cleaning equipment 67*a*, 67*b*, a primary cleaning may be provided for the semiconductor wafer, while in the cleaning equipment 68*a*, 68*b*, a secondary cleaning may be provided for the semiconductor wafer subsequently to the primary cleaning.

Figure 7:
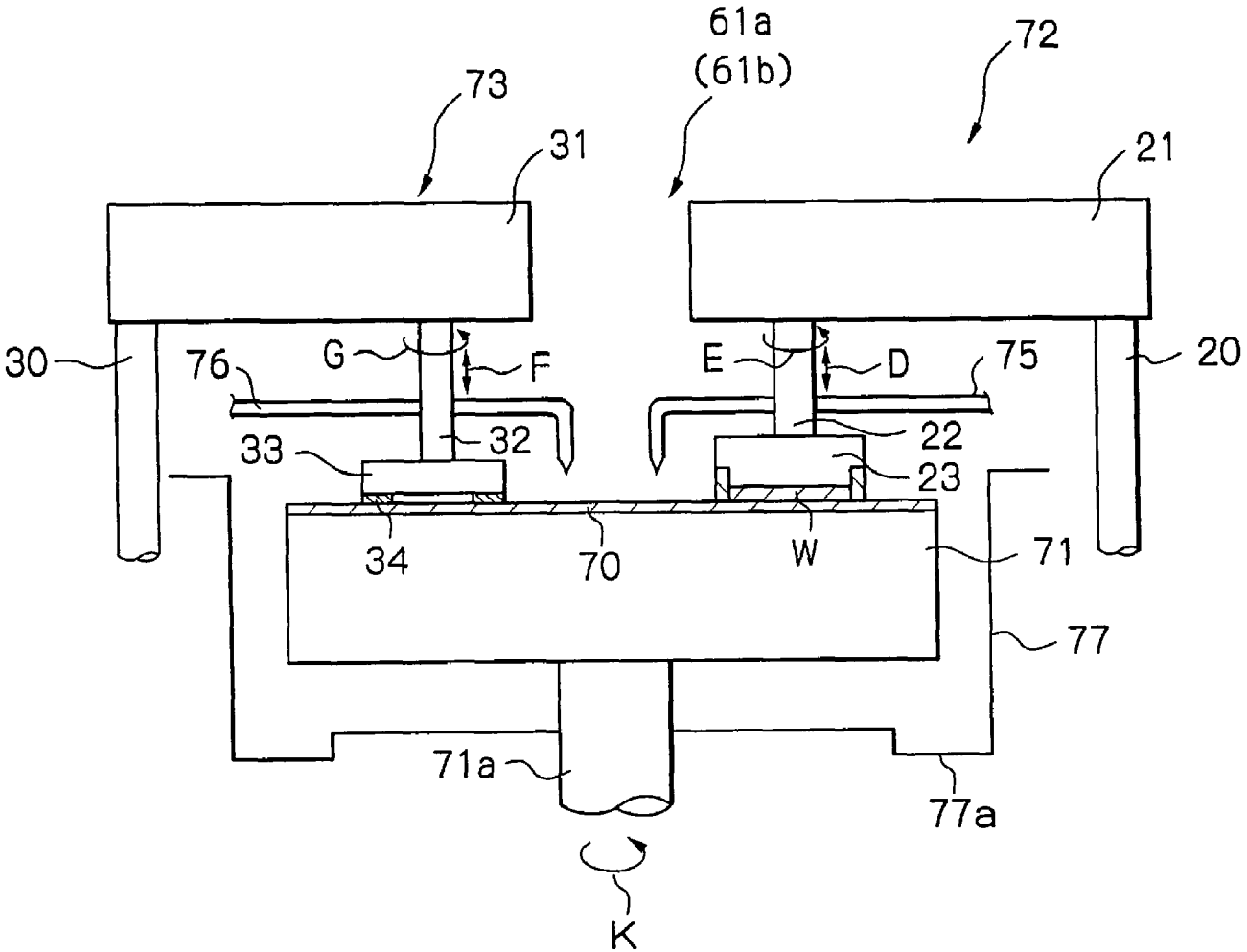
FIG. 7 is a schematic view showing main components of a polishing section of the polishing apparatus shown in FIG. 6.

A detailed configuration of the polishing section discussed above will now be described. FIG. 7 is a schematic view showing main components of the polishing section 61*a* or 61*b* in FIG. 6. It is to be noted that although only the polishing section 61*a* will be described below, the polishing section 61*b* may be considered similar to the polishing section 61*a*.

As shown in FIG. 7, the polishing section 61*a* comprises the polishing table 71 having the polishing surface 70 formed on the front surface thereof, the top ring unit 72 for retaining a semiconductor wafer "W" by a vacuum suction and for pressing said semiconductor wafer against the polishing table 71 so as to polish said semiconductor wafer, and the dressing unit 73 for dressing the polishing surface 70 of the polishing table 71. The polishing table 71 is coupled via a table shaft 71*a* to a motor (not shown) arranged below the polishing table 71 and the polishing table 71 is configured to be rotatable about the table shaft 71*a* as indicated by the arrow K in FIG. 7.

In the present embodiment, the polishing surface functioning for polishing the semiconductor wafer W is made up of a bonded abrasive composed of abrasive grains and pores or porous material which have been bonded together with a binder (resin). The bonded abrasive may employ, for example, cerium dioxide as the abrasive grains and thermoplastic resin as the binder. It is to be appreciated that the polishing surface is not limited to the form of the bonded abrasive but may be formed by a polishing cloth. For the purpose of the present invention, the polishing cloth means an expanded polyurethane or a non-woven fabric containing no abrasive grains inside thereof.

An abrasive liquid supply nozzle and a water supply nozzle 76 are disposed above the polishing table 71, wherein the abrasive liquid such as a purified water and a chemical solution may be supplied from the abrasive liquid supply nozzle while the dressing liquid (e.g., water) used for the dressing may be supplied from the water supply nozzle 76 respectively over the polishing surface 70 of the polishing table 71. In addition, a frame structure 77 for recovering those abrasive liquid and water is arranged in a periphery of the polishing table 71 and the frame structure 77 includes a gutter 77*a* formed in a lower portion thereof.

The top ring unit 72 comprises a rotatable support rod 20, a swing arm 21 coupled to an upper end of the support rod 20, a top ring shaft 22 extending downward from a free end of the swing arm 21, and a top ring 23 in an approximately disk-like shape coupled to a lower end of the top ring shaft 22. The top ring 23 is capable of moving in the horizontal direction in conjunction with a swing motion of the swing arm 21 driven by the rotation of the support rod 20 so as to perform a reciprocating motion between a position above the pusher 74 and a polishing position above the polishing surface 70, as indicated by the arrow A in FIG. 6.

Further, the top ring 23 is coupled via the top ring shaft 22 to a motor (a rotary mechanism) and a lifting and lowering cylinder, which are not shown but arranged within the swing arm 21, so that the top ring 23 is allowed to be lifted or lowered and also rotated about the top ring shaft 22, as indicated by the arrows D, E in FIG. 7. Besides, the semiconductor wafer W, the workpiece to be polished, is suctioned and thus retained on the lower end surface of the top ring 23 by using vacuum or the like. With the aid of those mechanisms, the top ring 23 can press the semiconductor wafer W held on the under surface thereof against the polishing surface 70 with an arbitrary pressure applied thereto, while rotating about its own axis.

The dressing unit 73 functions to regenerate the polishing surface 70, which has been deteriorated through the polishing process, and the dressing unit 73 is disposed in a location opposite to the top ring unit 72 with respect to the center of the polishing table 71. The dressing unit 73, similarly to the above-described top ring unit 72, comprises a rotatable support rod 30, a swing arm 31 coupled to an upper end of the support rod 30, a dresser shaft 32 extending downward from a free end of the swing arm 31, and a dresser 33 coupled to a lower end of the dresser shaft 32. The dresser 33 is capable of moving in the horizontal direction in conjunction with a swing motion of the swing arm 31 driven by the rotation of the support rod 30 so as to perform a reciprocating motion between a dressing position above the polishing surface 70 and a stand-by position off the polishing table 71, as indicated by the arrow J in FIG. 6.

Figure 8:
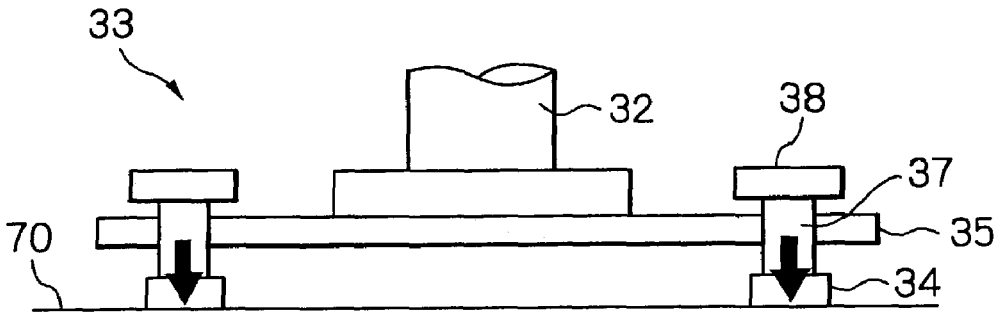
FIG. 8 is a schematic view showing a dresser of the polishing section shown in FIG. 7.
Figure 9:
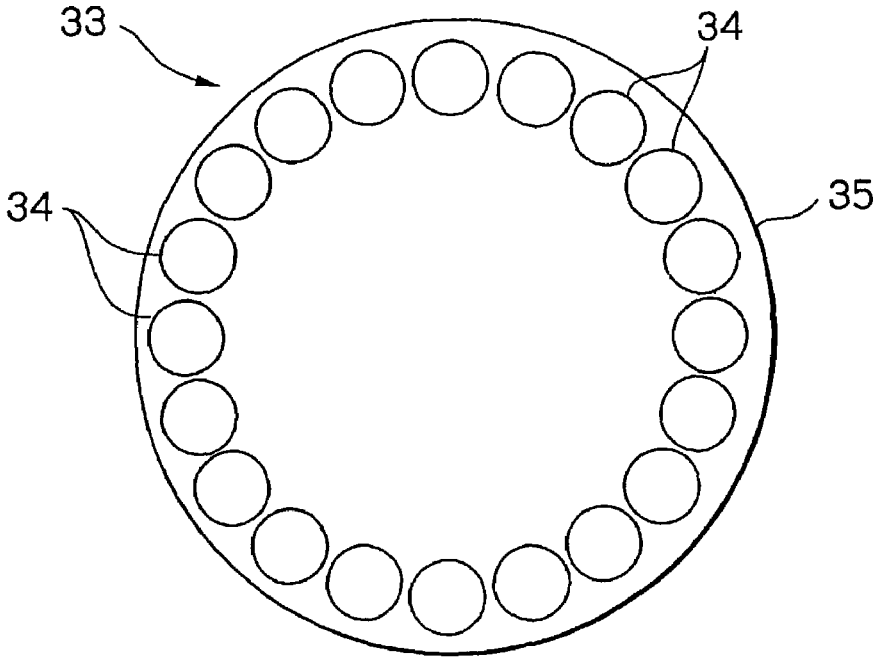
FIG. 9 is a bottom plan view of the dresser of the polishing section shown in FIG. 7.

FIG. 8 is a schematic view of the dresser 33 shown in FIG. 7, and FIG. 9 is a bottom plan view of the dresser 33 shown in FIG. 7. As shown in FIG. 8 and FIG. 9, a plurality of dressing elements 34 are arranged on an under surface of the dresser 33, which are to be brought into sliding contact with the polishing surface 70 so as to provide the dressing operation for the polishing surface 70. The dresser 33 presses those dressing elements 34 against the polishing surface 70 at any arbitrary pressures while rotating, thereby carrying out the dressing operation of the polishing surface. The dresser 33 further comprises a flange portion 35 in an approximately disc-like shape coupled to the lower end of the dresser shaft 32, and the above-described dressing elements 34 are installed in an outer periphery of this flange portion 35. In the present embodiment, a diamond pellet is used as a material for the dressing element 34, in which grains such as diamond particles is attached onto a plate by electro-deposition, and as shown in FIG. 9, twenty pieces of thus formed dressing elements 34 are arranged on the dresser 33 with equally spaced along a circumferential direction.

Figure 10:
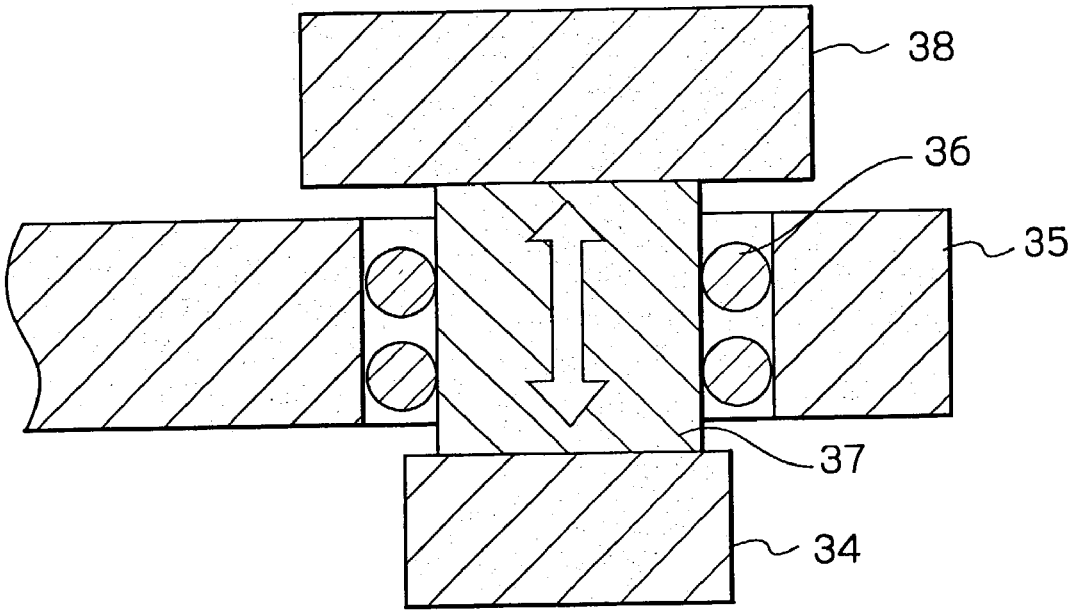
FIG. 10 is an enlarged sectional view of an outer periphery of the dresser shown in FIG. 8.

FIG. 10 is an enlarged sectional view of the dresser 33 shown in FIG. 8. As shown in FIG. 10, each dressing element 34 is attached to the lower end of a retainer shaft 37 which is supported by a bearing 36 arranged in an outer periphery of the flange portion 35 of the dresser 33. Owing to this structure, the dressing element 34 is allowed to move up and down relative to the flange portion 35. That is, the retainer shaft 37 and the bearing 36 together make up a retaining mechanism for operatively retaining the dressing element 34 so as to move it up and down relative to the flange portion 35. In addition, a weight 38 having a predetermined weight is attached to an upper end of the retainer shaft 37. It is to be noted that a translatory mechanism such as a linear guide or a spline shaft may be used for such a retaining mechanism.

Figure 11:
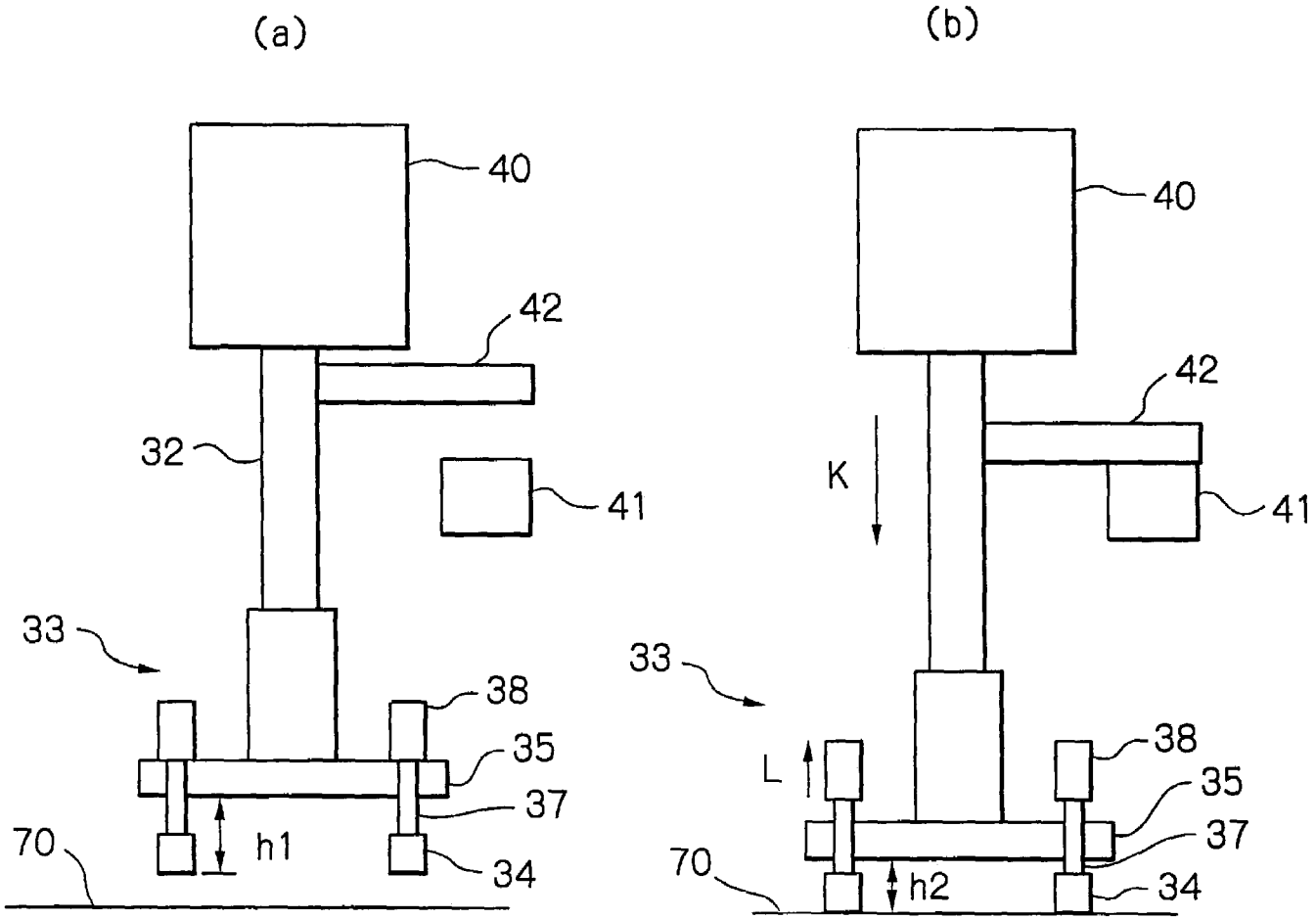
FIGS. 11(*a*) and (*b*) are schematic views respectively showing a mechanism for lifting and lowering the dresser shown in FIG. 8.

FIG. 11(*a*) and FIG. 11(*b*) are schematic views respectively illustrating the upward movement (indicated by an arrow K) and downward movement of the dresser 33 shown in FIG. 8. As shown in FIG. 11(*a*) and FIG. 11(*b*), the upper end of the dresser shaft 32 is coupled to an air cylinder 40 housed in the swing arm 31, so that the dresser 33 may be driven by the air cylinder 40 so as to be moved up and down relative to the polishing surface 70, as indicated by the arrow F in FIG. 7. Further, the dresser shaft 32 is also coupled to the motor (not shown) housed in the swing arm 31, so that the dresser 33 may be driven by the motor so as to rotate about the dresser shaft 32, as indicated by the arrow G in FIG. 7.

A stopper 41 (not shown in FIG. 7) is fixed to the swing arm 31 at a predetermined height level thereof, and the dresser shaft 32 is provided with an engaging portion 42 corresponding to this stopper 41. Accordingly, as the dresser 33 is driven by the air cylinder 40 to be lowered from its lifted-up position (see FIG. 11(*a*)), the engaging portion 42 of the dresser shaft 32 is brought into engagement with the stopper 41 so as to place the dresser 33 in position in the up and down direction, as shown in FIG. 11(*b*). As discussed above, in the present embodiment, the air cylinder 40, the engaging portion 42 of the dresser shaft 32 and the stopper 41 together construct a mechanical vertical motion control mechanism for controlling the position of the dresser 33 (flange portion 35) in the up and down direction. It is to be noted that preferably a lock mechanism may be additionally provided, which locks the dresser 33 in thus determined position.

Under the condition shown in FIG. 11(*a*), owing to the weight of the weight 38 (plus own weights of the support rod 37 and the dressing element 34), the weight 38 comes into contact with the upper surface of the flange portion 35, thereby bringing the dressing element 34 into a state where it is hanging downward from the flange portion 35. A height "h1" defined from the under surface of the dressing element 34 to the under surface of the flange portion 35 in this condition has been set to be greater than a height "h2" defined from the polishing surface 70 to the under surface of the flange portion 35 as measured when the engaging portion 42 of the dresser shaft 32 has come into engagement with the stopper 41 (see FIG. 11(*b*)). Accordingly, if the dresser 33 is further lowered after the dressing elements 34 have come into contact with the polishing surface 70, the support rod 37 and the weight 38 would be moved up with respect to the flange portion 35.

As a result, the dressing element 34 is pressed against the polishing surface 70 with the weight of the weight 38 (plus own weights of the support rod 37 and the dressing element 34). Therefore, adjusting the weight of the corresponding weight 38 makes it possible to control the pressing pressure from each dressing element 34, and in turn controlling the pressing pressure from each dressing element 34 makes it possible to increase the contact area of the dressing elements 34 with the polishing surface 70 in a positive manner and allow the dressing elements 34 to follow the contour of the polishing surface. As discussed above, in the present embodiment, such a follow-up mechanism has been constructed, in which individual dressing elements 34 are allowed to move up and down with respect to the flange portion 35 with the aid of the respective weights 38 having predetermined weights thus to control the dressing elements 34 so as to follow the polishing surface.

Then, an operation in performing the polishing and the dressing processes of the semiconductor wafer W by using the polishing apparatus having the configuration as discussed above will be described.

For performing the polishing operation of the semiconductor wafer W in the polishing section 61*a*, 61*b*, the semiconductor wafer W held by the top ring 23 and the polishing table 71 are caused to make relative motions with respect to each other thus to press the semiconductor wafer W held on the under surface of the top ring 23 against the polishing surface 70 on the polishing table 71 while rotating the top ring 23 and the polishing table 71 independently about their own axes. At that time, simultaneously the abrasive liquid is supplied over the polishing surface 70 from the abrasive liquid supply nozzle. It is to be noted that the abrasive liquid is scattered outwardly off the polishing table 71 under a centrifugal force caused by the rotation of the polishing table 71, and is recovered in the gutter 77*a* located in the lower portion of the frame structure 77.

The polishing process is ended at the time when the semiconductor wafer W has been polished by a predetermined abrasive amount, and it is observed at the completion of this polishing process that a characteristic of the polishing surface 70 has been somehow changed and its polishing ability has been deteriorated for a subsequent polishing process, that is why the dressing is applied to the polishing surface 70 by the dressing unit 73. In this dressing process, the dressing element 34 are brought into contact with the polishing surface 70 at predetermined pressures while rotating the dresser 33 and the polishing table 71 independently about their own axes.

At that time, in synchronism with or before the contact of the dressing elements 34 with the polishing surface 70, the water is supplied over the polishing surface 70 from the water supply nozzle 76 so as to clean out the used abrasive liquid remaining on the polishing surface 70. After having completed the dressing process, the dresser 33 is returned back to its stand-by position by driving the swing arm 31, where it is cleaned by a dresser cleaning equipment 78 (see FIG. 6) installed in this stand-by position.

As discussed above, in this dressing process, the pressing pressure from the dressing elements 34 can be controlled by adjusting the individual weight of the weight 38 for each corresponding dressing element 34. Accordingly, through this individual adjustment of the pressing pressure from each one of the dressing elements 34, the contact area of the dressing elements 34 with the polishing surface 70 can be increased positively and at the same time each dressing element 34 is allowed to follow the contour of the polishing surface, so that the uniform dressing can be applied to the polishing surface.

Further, since the pressing pressure from each one of the dressing elements 34 can be adjusted individually, therefore the adequate dressing can be achieved to the polishing surface, thus improving the uniformity of the residual film across the surface in the semiconductor wafer after the polishing process. Consequently, this may improve the yield. It is to be noted that if the swing arm 31 of the dressing unit 73 is swung during the dressing process, more uniform dressing should be achieved.

The dressing operation was actually performed by using twenty pieces of dressing elements, each of which is in a circular cylindrical shape with a diameter of 20 mm and contains the diamond particles electrically deposited thereon, with a total loading of 10N applied to the dressing elements during the dressing operation. A result from this dressing operation shows that the uniformity across the surface of the semiconductor wafer was improved from about 20% to about 6% as compared to the dressing performed by using the conventional plate-like dressing element.

It is to be appreciated that in the embodiment shown in FIGS. 11(*a*), 11(*b*), the follow-up mechanism has been composed of the weight 38 having a predetermined weight, but the weight may not be necessarily provided as a separate component but the dressing element 34 and the support rod 37 may take a role of weight by themselves by adjusting the own weights of the dressing element 34 and the support rod 37.

Figure 12:
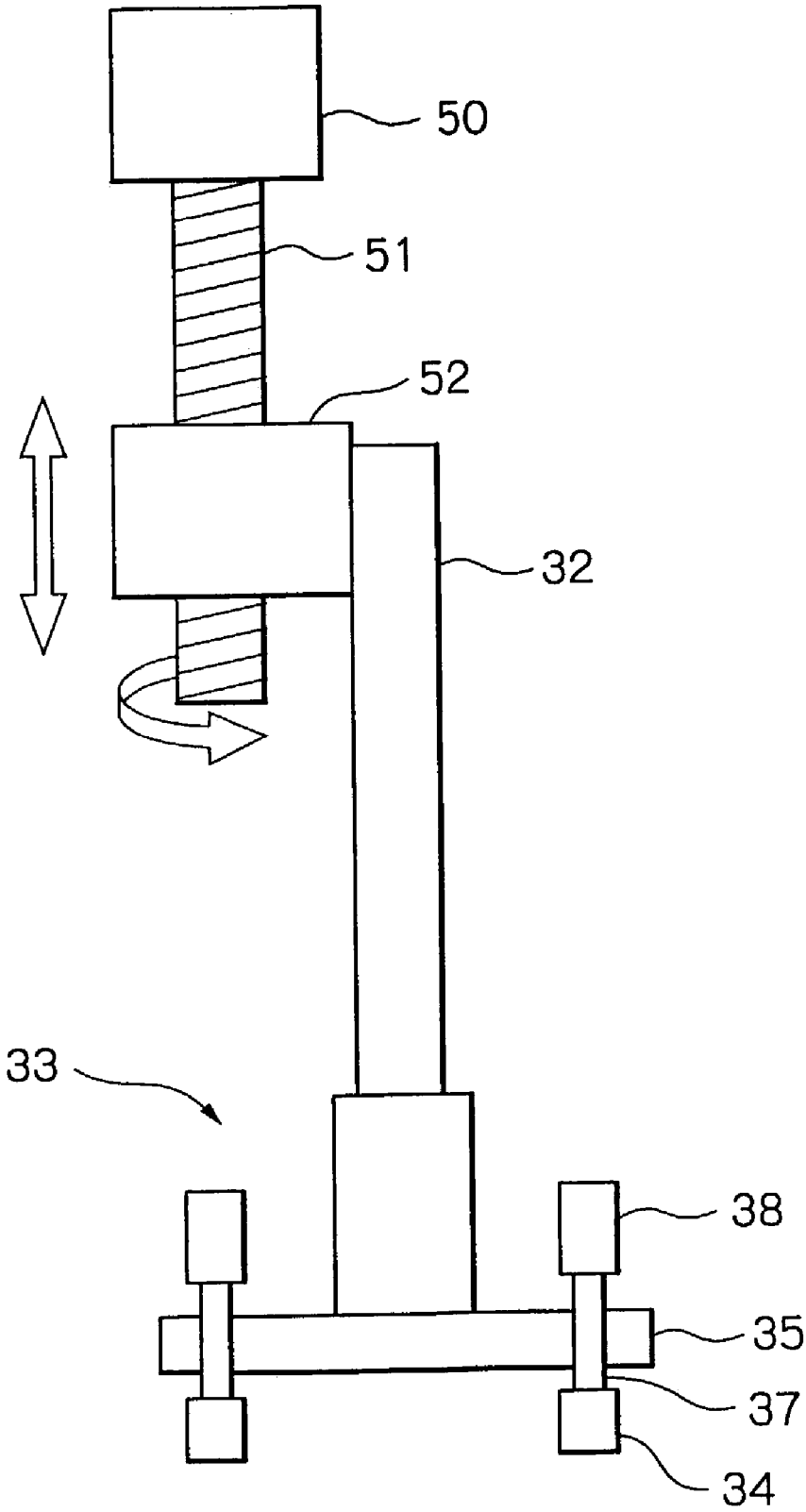
FIG. 12 is a schematic view showing a dresser of a polishing apparatus according to a fourth embodiment of the present invention.

In the embodiment shown in FIGS. 11(*a*) and 11(*b*), the dresser 33 has been moved up and down by driving the air cylinder 40, but the present invention is not limited to this configuration. For example, as shown in fourth embodiment in FIG. 12, a shaft screw 51 attached to a motor 50 may be thread-engaged with a ball screw 52, to which an upper end of the dresser shaft 32 may be coupled, as shown in FIG. 12. With this configuration, the dresser 33 can be moved up and down via the ball screw 52 by driving the motor 50. In addition, the positioning of the dresser 33 in the vertical direction, which has been discussed above, may be provided through a pulse control of the motor 50 for example. In this way, the motor 50, the shaft screw 51 and the ball screw 52 may together construct the mechanical vertical motion control mechanism.

Figure 13:
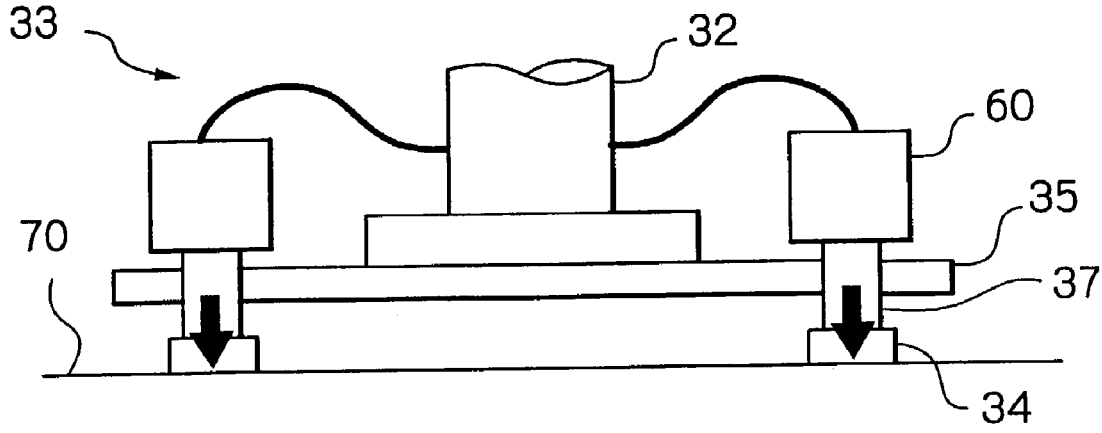
FIG. 13 is a schematic view showing a dresser of a polishing apparatus according to a fifth embodiment of the present invention.
Figure 14:
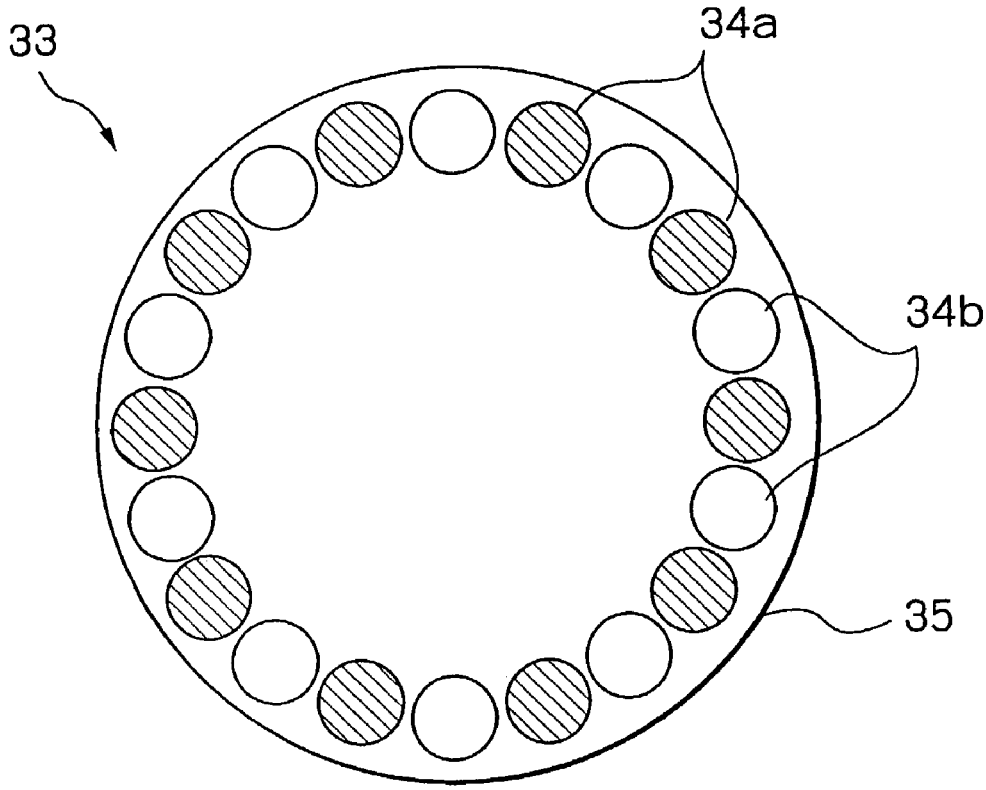
FIG. 14 is a bottom plan view of a dresser of a polishing apparatus according to a sixth embodiment of the present invention.
Figure 15:
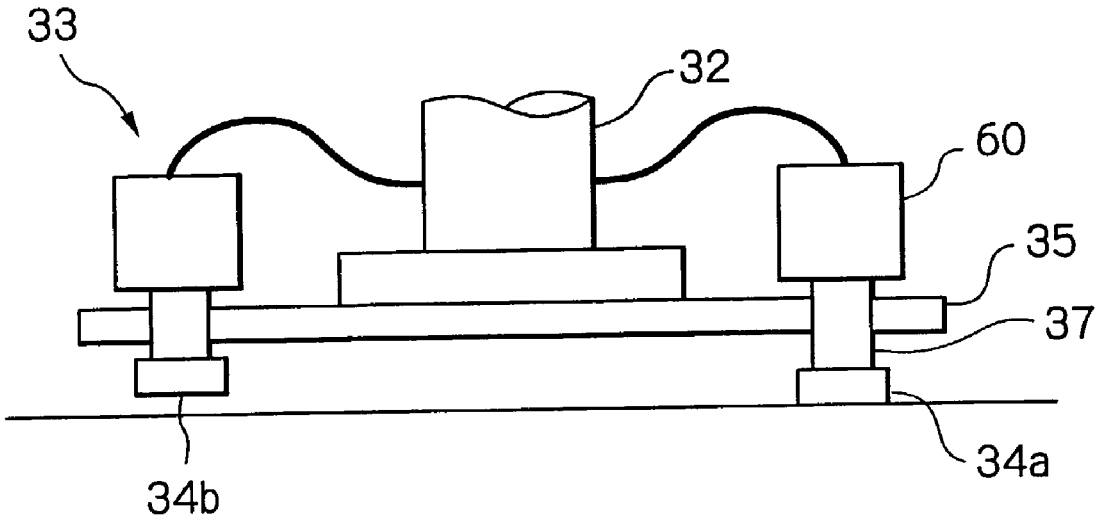
FIG. 15 is a schematic view showing an operating state of the dresser shown in FIG. 14.
Figure 16:
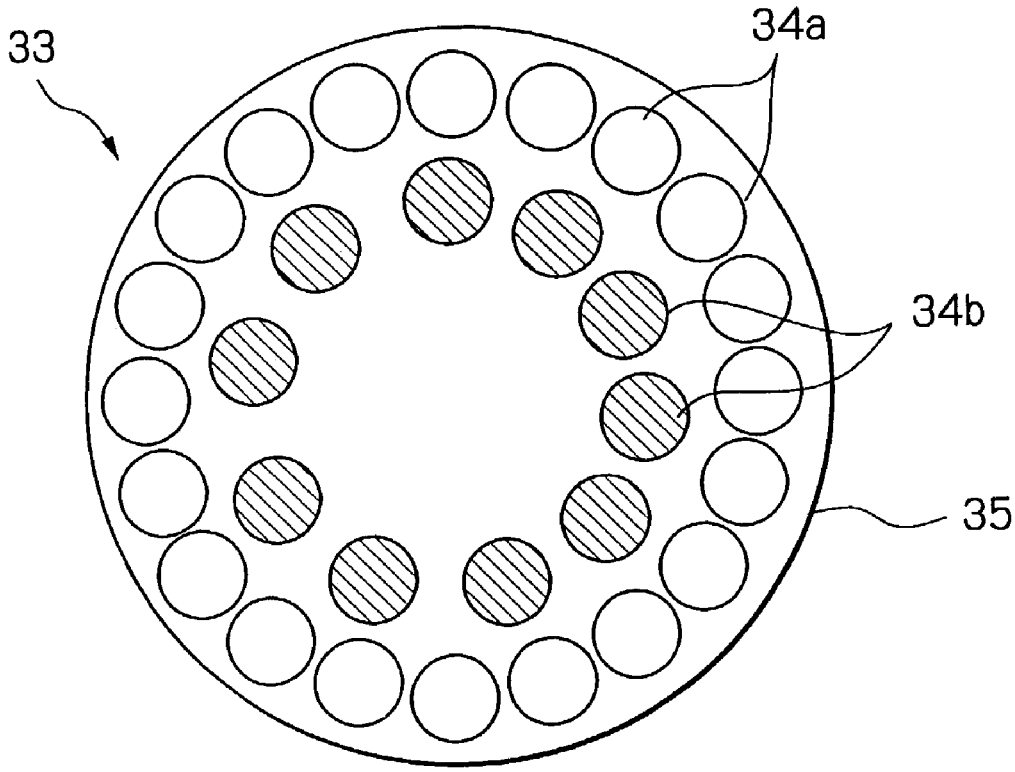
FIG. 16 is a bottom plan view of a dresser of a polishing apparatus according to an eighth embodiment of the present invention.

FIG. 13 is a schematic view of a dresser according to a fifth embodiment of the present invention. In contrast to the preceding first embodiment, in which the example of the function made up of the weight having the predetermined weight has been explained, this second embodiment employs a function implemented by an air cylinder that can move the dressing elements up and down by supplying a fluid thereto.

In specific, as shown in the fifth embodiment in FIG. 13, an air cylinder 60 is installed to an upper end of each support rod 37 of the dresser 33. Accordingly, the dressing element 34 can be lowered with respect to the flange portion 35 by supplying a pressurized fluid to the air cylinder 60, and so each one of the dressing elements 34 can be pressed against the polishing surface with a predetermined pressing pressure applied thereto. In this way, use of the air cylinder 60 can provide a simpler adjustment of the pressing pressure of the dressing element 34 as compared to the first embodiment, thereby allowing for more precisely specified dressing conditions.

In this case, the air cylinder 60 may be controlled also to be in a negative pressure. If the air cylinder 60 is held in the negative pressure, a total loading from the own weights of the dressing element 34, the support rod 37 and the air cylinder 60 can be reduced by the air cylinder 60, and so the dressing under a light load may be applicable.

Further, the follow-up mechanism described above may be driven to move up and down the dressing element 34 by supplying the fluid other than the air, including the water for example, or otherwise a restoring force from an elastic body deformation, an electromagnetic force or a biasing force from a spring may be used to move the dressing element up and down.

Further, a plurality of dressing elements 34 may be made up of different kinds of dressing elements (for example, a plurality of dressing elements with different grain sizes of diamond particles electrically deposited thereon), wherein those different kinds of dressing elements may be independently used according to the different applications. For example, a sixth embodiment shown in FIG. 14, the shaded dressing elements 34*a* may be electrically deposited with coarse diamond particles, while the other dressing elements 34*b* may be electrically deposited with fine diamond particles. Herein, in a first dressing stage, only the dressing elements 34*a* having a higher dressing rate may be pressed by the air cylinders 60 (see a seventh embodiment shown in FIG. 15), and then in a subsequent step, the dressing elements 34*b* having a relatively lower dressing rate may be pressed by the air cylinders 60. This allows the polishing surface 70 to be dressed more adequately thus to reduce the occurrence of defects and improve the throughput. In this case, those different kinds of dressing elements 34*a*, 34*b* may be arranged to be double or more circles in one example, as shown in a eighth embodiment in FIG. 16.

Figure 17:
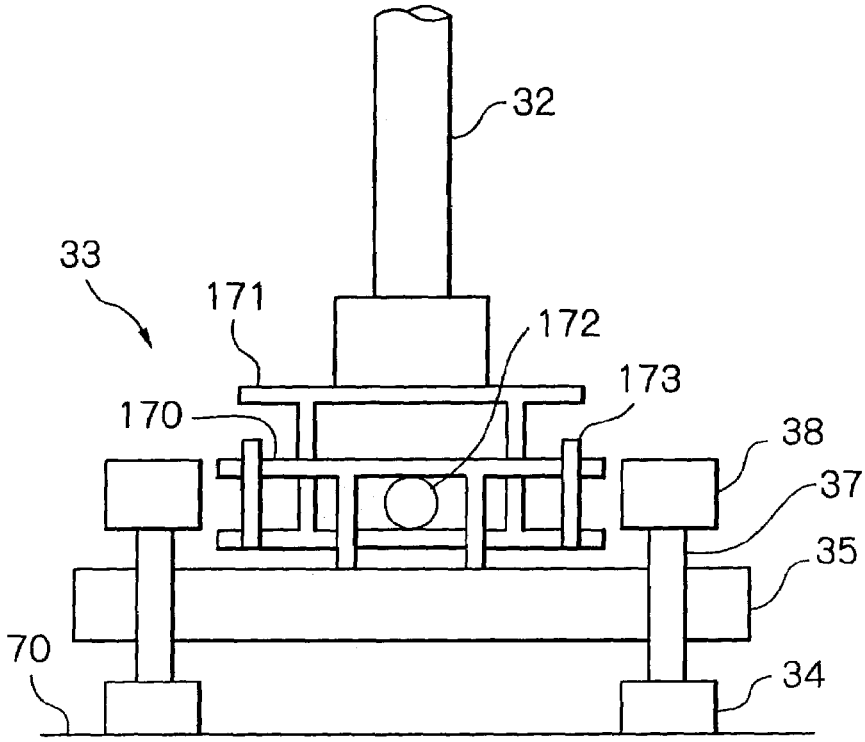
FIG. 17 is a schematic view of a dresser of a polishing apparatus according to a ninth embodiment of the present invention.
Figure 18:
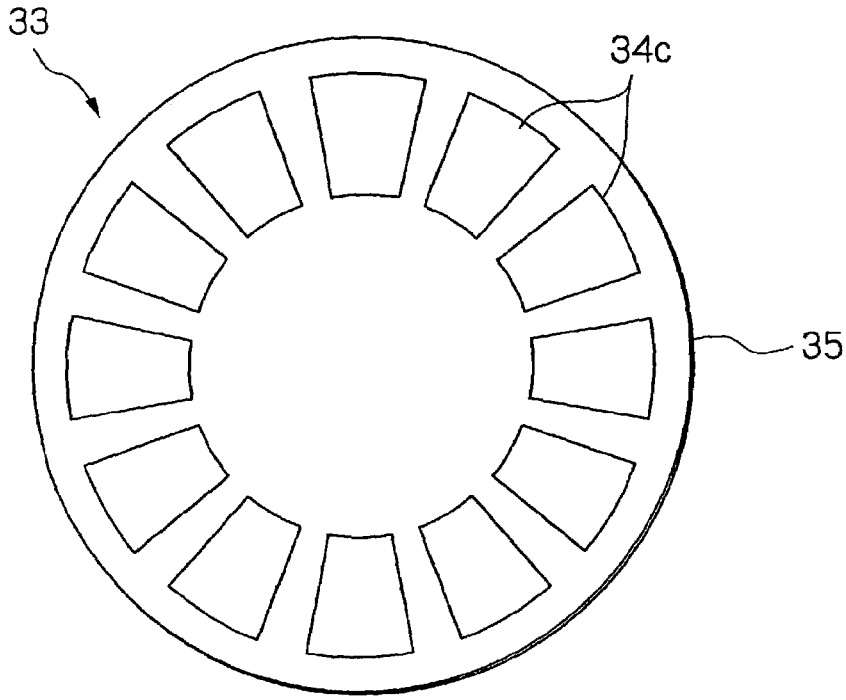
FIG. 18 is a bottom plan view showing a dresser of a polishing apparatus according to a tenth embodiment of the present invention.
Figure 19:
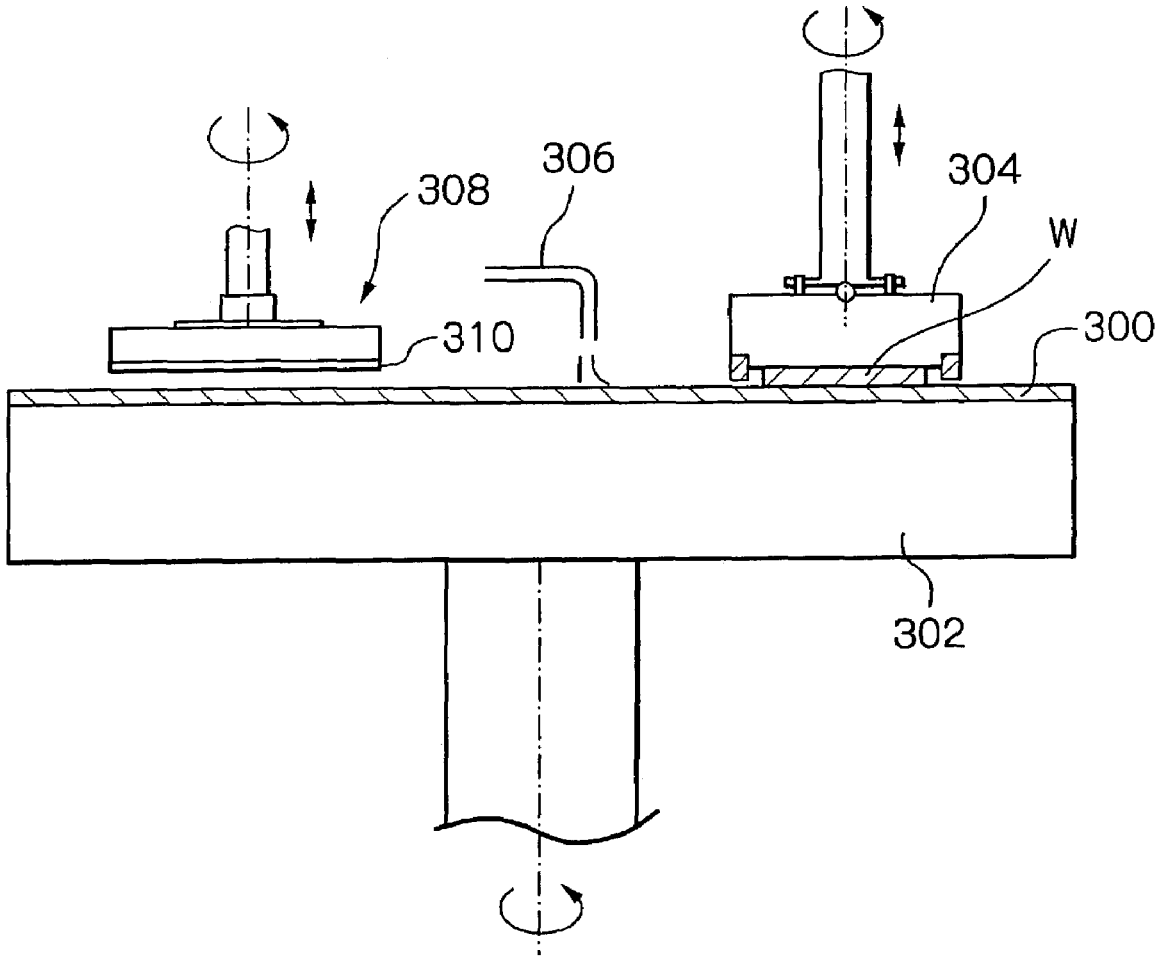
FIG. 19 is a schematic sectional view showing a polishing apparatus according to a prior art.

FIG. 17 is a schematic view of a dresser according to a ninth embodiment of the present invention. This embodiment is different from the preceding first embodiment in that a gimbal mechanism has been employed in a connection between the dresser shaft 32 and the flange portion 35. This gimbal mechanism comprises a flange side connecting section 170 attached onto the upper surface of the flange portion 35, a shaft side connecting section 171 attached onto the lower end of the dresser shaft 32, a ball bearing 172 for operatively connecting the flange side connecting section 170 with the shaft side connecting section 171 so as to be tiltable with respect to each other, and a rotation transmission pin 173 for transmitting the rotation of the flange side connecting section 170 to the shaft side connecting section 171. The flange portion 35 is adapted to rotate together with the dresser shaft 32 with the aid of the rotation transmission pin 173 of the-gimbal mechanism under a condition where the flange portion 35 is operatively supported by the ball bearing 172 of the gimbal mechanism so as to be tiltable with respect to the dresser shaft 32.

Although in-respective embodiments illustrated above, such an example has been described in which the diamond pellets in a circular cylindrical shape is employed as the dressing element 34, however, the geometry of the dressing element 34 is not limited to this, but a dressing element in a rectangular parallelepiped shape may be used. Further, such a dressing element 34*c* having a fan-shaped bottom surface as shown in a tenth embodiment in FIG. 18 may also be used, and other dressing elements having a variety of different bottom surface geometries may be used, including an elliptical shape, a triangular shape, an arcuate shape and a polygonal shape.

Further, in addition to the dressing element with diamond particles electrically deposited thereon, other materials, including ceramic, hard steel, a wire brush and a resin brush, may also be used as the dressing element. Furthermore, although in the above-described respective embodiments, such an example has been described in which the dressing operation is performed by bringing the dressing element into slide contact with the polishing surface, the present invention is not limited thereto but may be applicable to a dressing element, such as an optical dresser and an ultrasonic dresser for example, which may be used in a non-slide-contact manner with the polishing surface.

An example of a dressing process performed by using a polishing apparatus according to the present invention will now be described.

(1) A case where the dressing operation is performed during a polishing period (in-situ dressing):

(1-1) Two kinds of dressing elements each having different grain size from each other are used, wherein at a primary polishing, one dressing element having a high polishing rate (a coarse dressing element) is used for the dressing, and subsequently at the finish polishing, the other dressing element (a fine dressing element) which gives a lesser damage to a semiconductor wafer is used for the dressing.

(1-2) One kind of dressing element is used, wherein at a primary polishing, in order to obtain a high polishing rate, a greater load (40N–100N) is applied to the dressing element to perform the dressing operation, and subsequently at the finish polishing, in order to produce little damage on a semiconductor wafer, the load to be applied to the dressing element is reduced (to the range of 10N) to perform the dressing operation.

(2) A case where the dressing operation is performed during a period other than the polishing period (ex-situ dressing):

(2-1) Based on the consideration giving priority to the throughput in the dressing, a relatively larger load (40N–100N) is applied to a dressing element in order to regenerate the top surface of the polishing surface in a short time period, which has been deteriorated by the polishing.

(2-2) Based on the consideration giving priority to the damage on the semiconductor wafer, a relatively smaller load (10N) is applied to a dressing element to perform the dressing operation within a short time period because the dressing of the polishing surface may indirectly give the damage to the semiconductor wafer.

(3) A case where the dressing operation is performed until the middle of the polishing process but not performed in the finish polishing process: The dressing operation is performed until the middle of the polishing process by way of the in-situ dressing but the dressing operation is suspended during the finish polishing process from the consideration of damage to the semiconductor wafer.

(4) A case where the dressing operation is performed both during the polishing period and during a period other than the polishing period:

(4-1) In the dressing operation during the period other than the polishing period (ex-situ dressing), the dressing operation is performed by using a relatively coarse dressing element aiming also for correcting a contour of the polishing surface. In the dressing operation during the polishing period (in-situ dressing), the dressing operation is performed by using a fine dressing element from the consideration of damage to the semiconductor wafer.

(4-2) In the dressing operation during a period other than the polishing period (ex-situ dressing), the dressing operation is performed under a larger load applied to a dressing element aiming also for correcting a contour of the polishing surface. In the dressing operation during the polishing period (in-situ dressing), the dressing operation is performed under a smaller load applied to a dressing element from the consideration of damage to the semiconductor wafer.

Although some of the preferred embodiments of the present invention have been shown and described in detail, it should be understood that the present invention is not limited to those but various changes and modifications may be made therein without departing from the spirits and the scope of the inventive concept.

As described above, according to the present invention, since the individual dressing elements may be independently pressed against the polishing surface so as for each one of them to follow the contour of the polishing surface, more uniform dressing of the polishing surface can be achieved. Further, since the pressing pressure to be applied onto each one of the dressing elements can be adjusted individually, the uniformity across the surface in the workpiece to be polished as observed after the polishing may be improved and consequently the yield thereof may also be improved.

What is claimed is:

1. A polishing apparatus comprising:

a polishing surface;

a substrate holder for holding a substrate and bringing the substrate into contact under pressure with said polishing surface; and a dresser for dressing said polishing surface;

wherein said dresser comprises a flange portion capable of moving up and down relative to said polishing surface, a plurality of dressing elements operable to dress said polishing surface, a translatory mechanism for operatively retaining each of said dressing elements so as to move each of said dressing elements up and down relative to said flange portion, and a vertical motion control mechanism operable to control a position of said flange portion in an up and down direction.

2. The polishing apparatus according to claim 1, wherein said dresser further comprises a fluid supply mechanism allowing at least one of said dressing elements to move up and down.

3. The polishing apparatus according to claim 2, wherein said fluid supply mechanism allows one kind of dressing elements, from among said different kinds of dressing elements, to move up and down together, separately from other kinds thereof.

4. The polishing apparatus according to claim 1, wherein said plurality of dressing elements comprises different kinds of dressing elements.

5. A polishing apparatus comprising:

a polishing table having a polishing surface operable to polish a workpiece being pressed against said polishing surface, and a dresser operable to dress said polishing surface, wherein said dresser comprises a flange portion capable of moving up and down relative to said polishing surface of said polishing table, a dressing element operable to dress said polishing surface of said polishing table, a retainer mechanism for operatively retaining said dressing element so as to move said dressing element up and down relative to said flange portion, and a vertical motion control mechanism operable to control a position of said flange portion in an up and down direction.

6. The polishing apparatus according to claim 5, wherein said plurality of dressing elements comprises different kinds of dressing elements.

7. The polishing apparatus according to claim 6, wherein a function allows one kind of dressing elements, from among said different kinds of dressing elements, to move up and down together, separately from other kinds thereof.

8. The polishing apparatus according to claim 5, wherein said dresser further comprises a fluid supply mechanism which allows said dressing element to move up and down.

9. A polishing apparatus for polishing a substrate comprising:

a polishing surface;

a substrate holder for holding a substrate and bringing the substrate into contact under pressure with said polishing surface; and a dresser for dressing said polishing surface, wherein said dresser comprises a flange portion capable of moving up and down relative to said polishing surface, a dressing element operable to dress said polishing surface, a translatory mechanism for operatively retaining element so as to move said dressing element up and down relative to said flange portion, and a vertical motion control mechanism operable to control a position of said flange portion in an up and down direction.

10. The polishing apparatus according to claim 9, wherein said dresser further comprises a fluid supply mechanism allowing said dressing element to move up and down.

11. The polishing apparatus according to claim 9, wherein said dresser further comprises a weight attached to said dressing element.

12. A dresser for dressing a polishing surface, comprising:

a flange portion capable of moving up and down relative to the polishing surface;

a dressing element operable to dress the polishing surface;

a translatory mechanism for operatively retaining said dressing element so as to move said dressing element up and down relative to said flange portion; and a vertical motion control mechanism operable to control a position of said flange portion in an up and down direction.

* * * * *